US007467974B2

(12) United States Patent
Zhang

(10) Patent No.: US 7,467,974 B2
(45) Date of Patent: Dec. 23, 2008

(54) ELECTRICAL CONNECTOR

(75) Inventor: Han-Ming Zhang, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/894,111

(22) Filed: Aug. 20, 2007

(65) Prior Publication Data

US 2008/0045085 A1 Feb. 21, 2008

(51) Int. Cl.
*H01R 13/648* (2006.01)

(52) U.S. Cl. ..... 439/607; 439/71

(58) Field of Classification Search ..... 439/71, 439/330, 607–609

See application file for complete search history.

(56) References Cited

U.S. PATENT DOCUMENTS 7,223,125 B2 * 5/2007 Chen ..... 439/609
7,402,082 B2 * 7/2008 Zhang ..... 439/607
2007/0238357 A1 * 10/2007 Wang ..... 439/607

* cited by examiner

*Primary Examiner*—Khiem Nguyen
(74) *Attorney, Agent, or Firm*—Wei Te Chung

(57) ABSTRACT

An electrical connector (100) includes a shielding (10) defining a receiving space and a spring plate (20) mounted in the receiving space of the shielding. The shielding comprises a bottom wall (11) for supporting the spring plate therein. The spring plate defines a main body (21), a plurality of contacting portions (22) extending slantly upward from two opposite longitudinal ends of the main body, and a locking portion (24) and a retention portion (25) extending outward from two transverse ends of the main body for engaging with a corresponding locating slot (16) and a cutout (113) of the shielding thereby the spring plate soldered by laser beam to the bottom wall of the shielding to obtain reliable connection between the shielding and the spring plate.

10 Claims, 3 Drawing Sheets

ELECTRICAL CONNECTOR

BACKGROUND OF THE INVENTION

1. Field of the Invention

The present invention relates to an electrical connector, and particularly to an electrical connector used for a mobile phone or other electrical devices having different designs and configurations.

2. Description of the Related Art

With the rapid development of the technology of wireless communication and advanced technology of electrics, electronic consuming products such as mobile phone, Personal Digital Assistant (PDA) etc., are designed to comply with miniaturization trend and multiple functions such as mounting a camera thereon to meet with requirements of human. As a result, electrical connectors for accommodating the cameras therein are correspondingly demanding.

Usually, these electrical connectors used for accommodating and electrically connecting the camera module with the consuming products each provides a plurality of terminals engaged with a metal shielding in a way of assembling. Please refer to a related electrical connector shown in FIG. 1, the connector comprises a metal shielding 3 defining a receiving space 4 for receiving a camera module (not shown) therein and a spring plate 2 engaged with the receiving space 4 of the shielding 3. The shielding 3 defines a bottom wall 30, a front wall 31 extending upward from an edge of the bottom wall 30, a back wall 32 opposite to the front wall 31, a left wall 33 and a right wall 34 connecting with the front wall 31 and the right wall 32, respectively. The receiving space 4 is formed between the walls 30, 31, 32, 33 and 34. A pair of openings 35 is formed on a middle portion of the bottom wall 30. The spring plate 2 defines a main body 20 engaged with the bottom wall 30 of the shielding 3, and a plurality of contacting portions 21 extending slantly and upwardly from two opposite longitudinal ends thereof. The main body 20 defines a pair of protrusions 22 adjacent to the longitudinal ends thereof, and a pair of hooks 23 corresponding to engage with the openings 35 of the shielding 3, extending downwardly from an inner side of a slot (not labeled) adjacent to the protrusions 22, respectively. When the connector is assembled, the spring plate 2 is received in the receiving space 4 and engaged with the shielding 3 via the hooks 23 interferentially engaging with the corresponding openings 35 of the shielding 3.

When the camera module engages with the connector via a printed flexible circuit board (FPC), the FPC is firstly inserted into the receiving space 4 of the shielding 3 and pressed onto the contacting portions 21 of the spring plate 2. Secondly, the camera module is received in the receiving space 4 and mounted onto the FPC to electrical connect with the spring plate 2 via the FPC. Thus, reliable electrical connection between the camera module and the connector is obtained.

However, because the spring plate 2 is only engaged with the shielding 3 via interference, and the hooks 23 is defined at two opposite ends of the spring plate 2, when the hook 23 is inserted into the opening 35, a middle portion of the main body 20 is easy to warp upwardly, which will make the contacting portions 21 of the spring plate 2 connect with the corresponding pads of the FPC reliably. Thus, reliable electrical connection between the camera module and the connector isn't obtained.

Hence, an improved electrical connector is desired to overcome the disadvantages of the related art.

BRIEF SUMMARY OF THE INVENTION

Therefore, a main object of the present invention is to provide an electrical connector assembled by laser beam to obtain reliable connection between the connector and a camera module.

To fulfill the above-mentioned object, an electrical connector and method assembling the same according to the present invention comprises a shielding member defining a receiving space for receiving an electrical device such as a camera module therein, a spring plate received in the receiving space of the shielding. The shielding comprises a bottom wall, a first wall and a second wall opposite to the first wall, both extending upwardly from two opposite ends of the bottom wall, a third wall and a forth wall opposite to the third wall, both extending upwardly from the other two opposite ends of the bottom wall. The receiving space is formed between the walls. The spring plate defines a longitudinal main body and a plurality of contacting portions extending slantly upward from two opposite longitudinal ends thereof. The main body defines a locking portion at a transverse end thereof to engage with corresponding locating slot of the shielding. During assembling the connector, the spring plate is inserted into the receiving space of the shielding, the locking portion engages with the corresponding locating slot of the shielding and a bottom surface of the main body is soldered onto the bottom wall of the shielding by laser beam thereby the connector is assembled completely.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are embodiments shown in the drawings presently preferred. As should be understood, however, the invention is not limited to the precise arrangements and instrumentalities shown. In the drawings.

DETAILED DESCRIPTION OF THE PREFERRED EMBODIMENT

Reference will now be made in detail to the preferred embodiment of the present invention.

Figure 1:
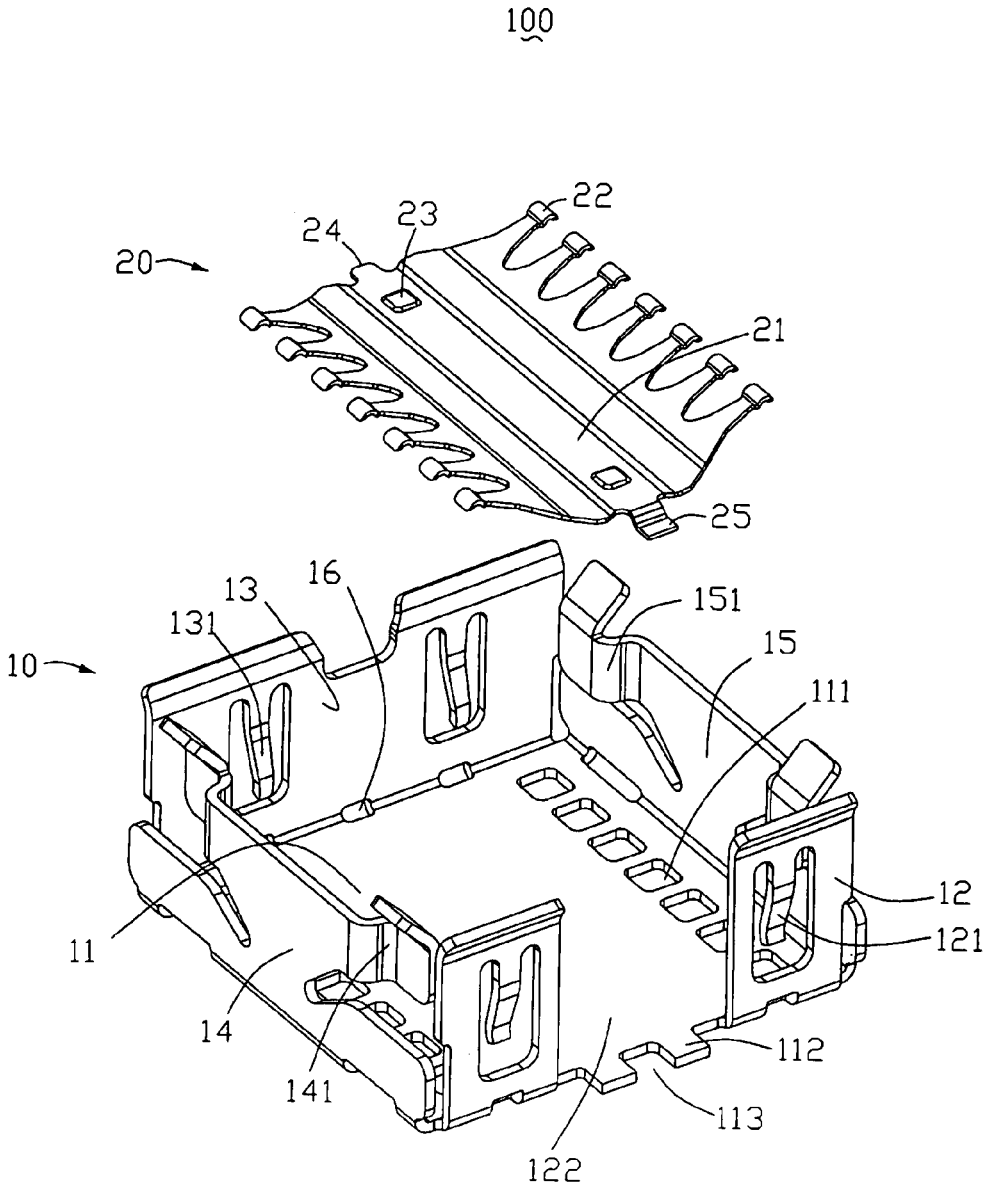
FIG. 1 is an exploded view of an electrical connector according to the present invention.
Figure 2:
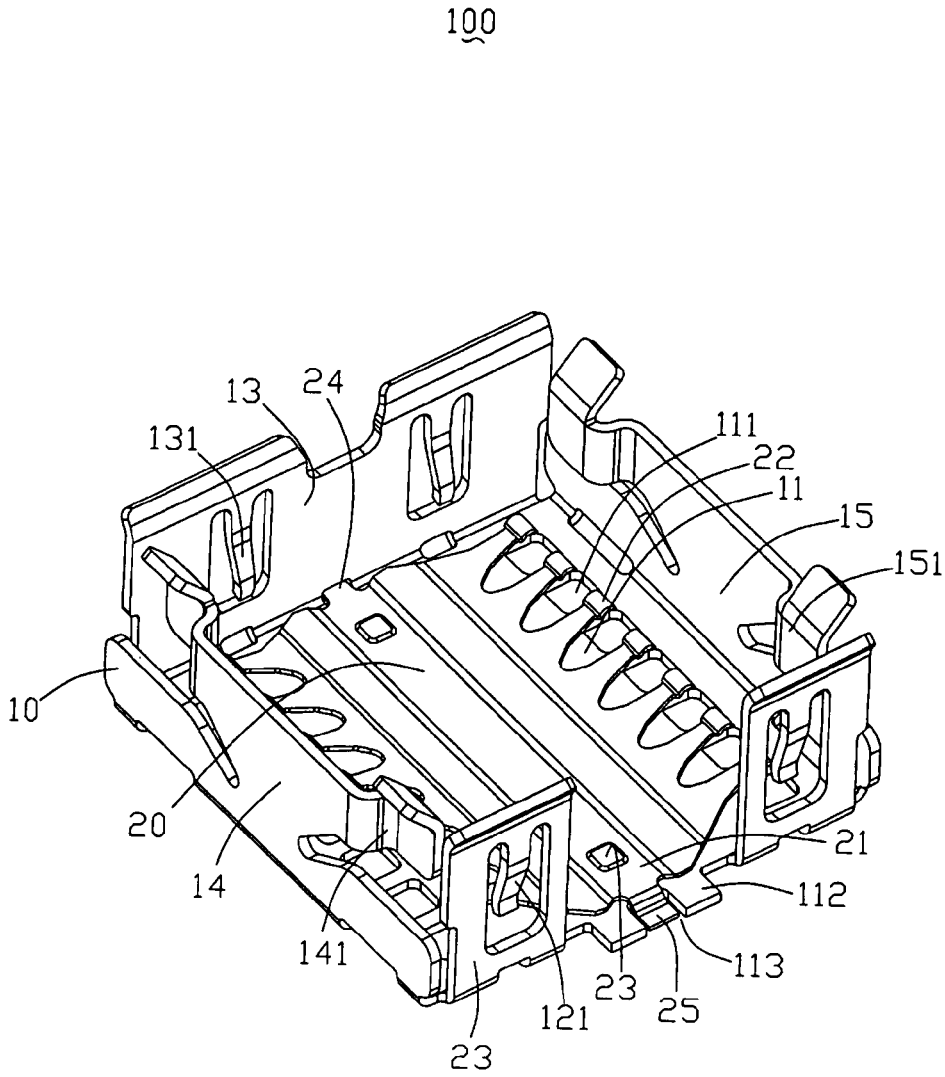
FIG. 2 is an assembled of FIG. 1.
Figure 3:
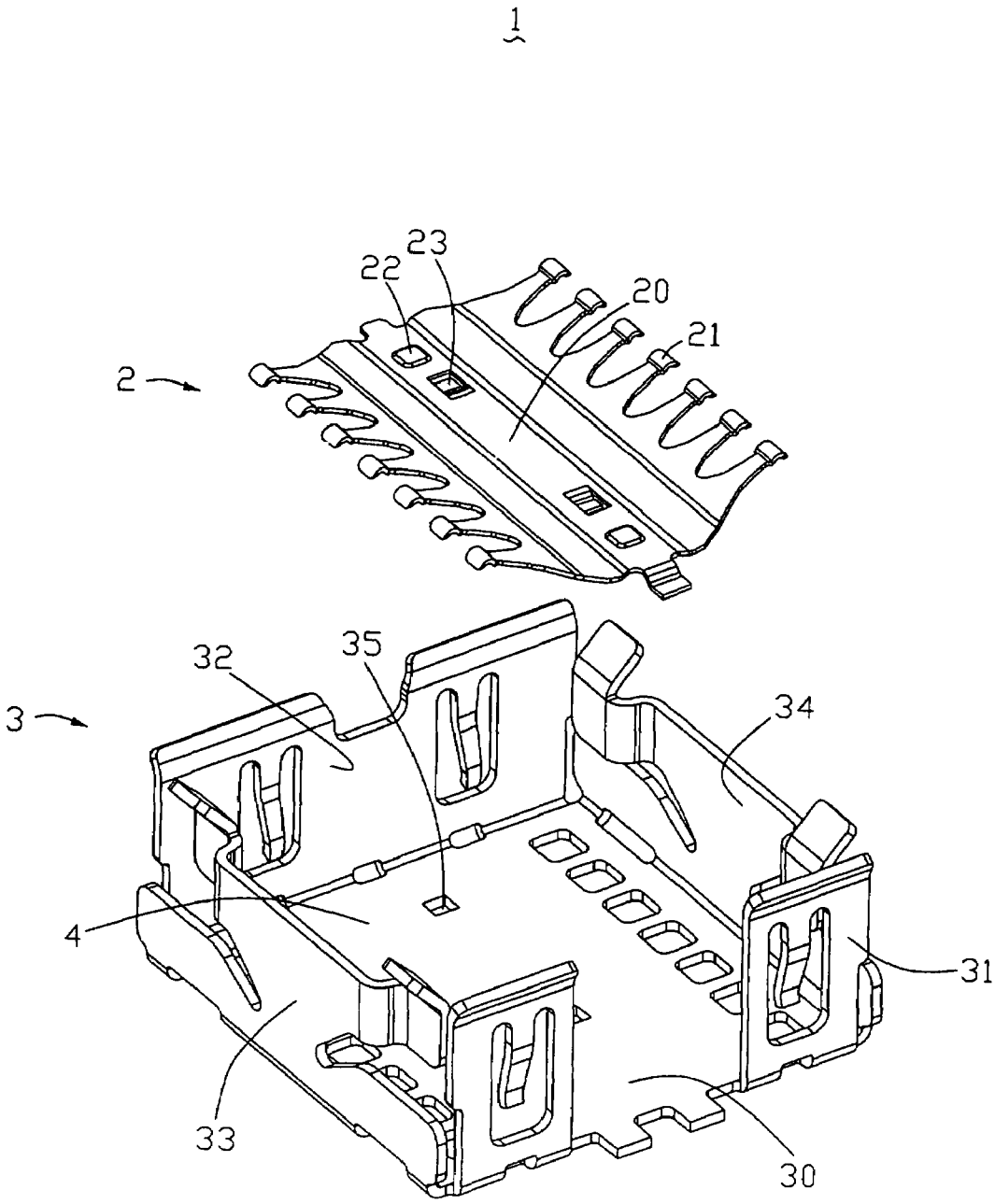
FIG. 3 (RELATED ART)
FIG. 3 is an exploded view of a related electrical connector.

Referring to FIGS. 1-2, an electrical connector 100 according to the present invention is adapted for receiving an electrical device such as a camera module (not shown) in the present embodiment. The electrical connector 100 comprises a shielding 10 accommodating the camera module, a spring plate 20 soldered onto the shielding 10 by laser beam.

The spring plate 20 defines a longitudinal main body 21 and a plurality of contacting portions 22 extending slantingly upward from two opposite sides of the main body 21. The main body 21 defines a locking portion 24 at one transverse end, a retention portion 25 at the other transverse end thereof, and a pair of protrusions 23 formed at an upper surface adjacent to the locking portion 24 and the retention portion 25.

The shielding 10 is firstly stamped from a metal sheet and then bent to form a rectangular configuration shown in the present invention. The shielding 10 includes a bottom wall 11, a first wall, a second wall, a third wall, a fourth wall 12, 13, 14, 15 which connect with one another in turn, together with the bottom wall 11 to form a receiving space (not labeled) for receiving the camera module therein. Each wall defines a sliding portion (not labeled) at a distal end thereof for sliding the camera module inserting into the receiving space. The bottom wall 11 defines a plurality of recesses 111 at two opposite ends thereof corresponding to the contacting portions 22 of the spring plate 2. Each of the first and second walls 12, 13 defines a pair of spring arms 121, 131 extending toward to the receiving space from a bottom portion of the sliding portion for fix the camera module in the receiving space. The first wall 12 defines a cavity 122 in a middle portion between the pair of spring arms 121 for guiding a flexible printed circuit board (not shown) inserted into the receiving space. A pair of ribs 112 extends outward of the cavity 122 from a side edge of the bottom wall 11 and a cutout 113 is formed between the ribs 112 to engage with corresponding the retention portion 25 of the spring plate 2. The second wall 13 defines a pair of locating slots 16 opposite to the cutout 113 and corresponding to the locking portion 24 of the spring plate 2 at a bottom edge thereof. Each of the third and forth walls 14, 15 defines a pair of second spring arms 141, 151 extending from an upper portion thereof.

When the electrical connector 100 is assembled, the spring plate 2 is inserted into the receiving space of the shielding 10 from the cavity 122 of the first wall 12, the locking portion 24 and the retention portion 25 is respective engaged with the locating slot 16 and the cutout 113 thereby engagement between the bottom wall 11 and the main body 21 is obtained. Furthermore, the main body 21 of the spring plate 2 and the bottom wall 11 of the shielding 10 is soldered together by laser beam to assembly the connector completely.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a shielding defining a bottom wall, a first and second walls respectively extending upward from two opposite ends of the bottom wall, and a third and forth walls respectively extending upward from the other two opposite ends of the bottom wall, the walls cooperative defining a receiving space for receiving an electrical device therein;

a longitudinal spring plate received in the receiving space of the shielding and defining a main body and a plurality of contacting portions extending slantingly upward from two opposite sides thereof;

the spring plate is received in the receiving space of the shielding via soldering the main body onto the bottom wall of the shielding by laser beam.

2. The electrical connector as described in claim 1, wherein the bottom wall defines a plurality of recesses at two opposite ends thereof corresponding to the contacting portions of the spring plate.

3. The electrical connector as claimed in claim 2, wherein each of the first and second walls defines a pair of spring arms extending toward to the receiving space from a bottom portion of the sliding portion for fix the electrical device in the receiving space.

4. The electrical connector as claimed in claim 3, wherein the first wall defines a cavity in a middle portion between the pair of spring arms for guiding a flexible printed circuit board inserted into the receiving space.

5. The electrical connector as claimed in claim 4, wherein a pair of ribs extends outward of the cavity from a side edge of the bottom wall and a cutout is formed between the ribs.

6. The electrical connector as described in claim 5, wherein each of the third and forth walls defines a pair of second spring arms extending from an upper portion thereof.

7. The electrical connector as claimed in claim 6, wherein the second wall defines a pair of locating slots opposite to the cutout.

8. The electrical connector as claimed in claim 7, wherein the main body defines a locking portion at one transverse end, a retention portion at the other transverse end thereof, and a pair of protrusions formed at an upper surface adjacent to the locking portion and the retention portion.

9. An electrical connector comprising:

a shielding defining a bottom wall surrounded by a plurality of upstanding side walls and cooperating with said side walls to commonly define a receiving space for receiving an electrical device therein;

a longitudinal spring plate received in the receiving space of the shielding and defining a main body and a plurality of contacting portions extending slantingly upward from two opposite sides thereof;

the spring plate is received in the receiving space of the shielding under a condition that the main body is soldered on the bottom wall of the shield without possibility of inadvertent withdrawal.

10. The electrical connector as claimed in claim 9, wherein one of said bottom wall and said main body defines at least one protrusion abutting against the other.

* * * * *